US008686815B2

(12) United States Patent
Sohn

(10) Patent No.: US 8,686,815 B2
(45) Date of Patent: Apr. 1, 2014

(54) APPARATUS OF MODULAR TRIP MECHANISM AND AUXILIARY MECHANISM FOR CIRCUIT BREAKER

(75) Inventor: Jong Mahn Sohn, Cheongju-Si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 13/545,901

(22) Filed: Jul. 10, 2012

(65) Prior Publication Data

US 2013/0015928 A1 Jan. 17, 2013

(30) Foreign Application Priority Data

Jul. 15, 2011 (KR) ..... 10-2011-0070578

(51) Int. Cl.

| | |
|---|---|
| ***H01H 77/00*** | (2006.01) |
| ***H01H 75/00*** | (2006.01) |
| ***H01H 83/00*** | (2006.01) |
| ***H01H 73/12*** | (2006.01) |
| ***H01H 67/02*** | (2006.01) |

(52) U.S. Cl.

USPC ..... 335/17; 335/132

(58) Field of Classification Search

USPC ..... 335/6, 17, 132

See application file for complete search history.

(56) References Cited

U.S. PATENT DOCUMENTS

| | | | | |
|---|---|---|---|---|
| 4,317,094 | A * | 2/1982 | Peterson | 335/13 |
| 5,581,219 | A * | 12/1996 | Nozawa et al. | 335/132 |
| 6,040,746 | A * | 3/2000 | Maloney et al. | 335/13 |
| 6,441,708 | B1 * | 8/2002 | Rodriguez et al. | 335/172 |
| 6,600,396 | B1 * | 7/2003 | Rodriguez et al. | 335/132 |
| 6,853,279 | B1 * | 2/2005 | Puskar et al. | 335/172 |
| 6,903,635 | B2 * | 6/2005 | Brignoni et al. | 335/6 |
| 6,943,652 | B2 * | 9/2005 | Rodriguez et al. | 335/6 |
| 7,843,291 | B2 * | 11/2010 | Titus | 335/132 |
| 7,923,650 | B2 * | 4/2011 | Greenberg et al. | 200/50.32 |

(Continued)

FOREIGN PATENT DOCUMENTS

| | | |
|---|---|---|
| EP | 0656641 | 6/1995 |
| EP | 1975965 | 10/2008 |

(Continued)

OTHER PUBLICATIONS

European Patent Office Application Serial No. 12176116.7, Search Report dated Oct. 30, 2012, 5 pages.

(Continued)

*Primary Examiner* — Alexander Talpalatski

(74) *Attorney, Agent, or Firm* — Lee, Hong, Degerman, Kang & Waimey

(57) ABSTRACT

An apparatus of modular trip mechanism and auxiliary mechanism for a circuit breaker comprises an auxiliary mechanism module including a first micro switch to output an electrical signal indicating an ON/OFF position of the circuit breaker, a first shaft contact lever mechanism to operate the first micro switch by contacting the switching shaft or receiving an artificial pressing force, a second micro switch to output an electrical signal indicating whether a trip operation of the circuit breaker has been performed, and a second lever to operate the second micro switch by contacting the switching shaft or receiving an artificial pressing force; and a trip mechanism module including an electromagnetic trip device to operate a trip bar to trigger the circuit breaker to a trip position in response to a trip control signal from an overcurrent relay or a test trip control signal from a test signal generating source.

7 Claims, 7 Drawing Sheets

(56) References Cited

U.S. PATENT DOCUMENTS

| | | | | |
|---|---|---|---|---|
| 7,961,480 | B2 * | 6/2011 | Besana et al. | 361/837 |
| 7,973,622 | B2 * | 7/2011 | Yang et al. | 335/13 |
| 2005/0024173 | A1 * | 2/2005 | Puskar et al. | 335/172 |
| 2006/0132269 | A1 * | 6/2006 | Kadah | 335/128 |
| 2008/0012664 | A1 * | 1/2008 | DeBoer et al. | 335/14 |
| 2008/0087534 | A1 * | 4/2008 | Yang et al. | 200/400 |
| 2009/0050459 | A1 * | 2/2009 | Ahn | 200/400 |
| 2011/0181379 | A1 * | 7/2011 | Sohn | 335/17 |

FOREIGN PATENT DOCUMENTS

| | | |
|---|---|---|
| EP | 2015339 | 1/2009 |
| JP | 2000-306486 | 11/2000 |
| JP | 2002-170473 | 6/2002 |

OTHER PUBLICATIONS

Japan Patent Office Application Serial No. 2012-156442, Office Action dated Sep. 2, 2013, 2 pages.

* cited by examiner

APPARATUS OF MODULAR TRIP MECHANISM AND AUXILIARY MECHANISM FOR CIRCUIT BREAKER

CROSS-REFERENCE TO RELATED APPLICATION

This application claims the benefit of earlier filing date and right of priority to Korean Application No. 10-2011-0070578, filed on Jul. 15, 2011, the contents of which are hereby incorporated by reference herein in their entirety.

BACKGROUND OF THE INVENTION

1. Field of the Invention

This disclosure relates to an apparatus of modular trip mechanism and auxiliary mechanism in a circuit breaker, such as an air circuit breaker having an overcurrent relay as a controller for detecting a fault current on an electrical power circuit and outputting a trip control signal upon detection of the fault current.

2. Background of the Invention

In low voltage circuit breakers for opening or closing an electrical power circuit having low voltage of several tens to several hundreds volts or automatically tripping a circuit upon detecting an occurrence of a fault current such as overcurrent or short-circuit current on the circuit, a representative of a circuit breaker having a relatively large capacity may be an air circuit breaker. The present disclosure relates to a low voltage circuit breaker with a large capacity.

As such a low voltage circuit breaker with a large capacity, circuit breakers according to the related art provided by the applicant of this disclosure includes a switching mechanism, a trip mechanism, a controller and an auxiliary mechanism.

Here, the switching mechanism, as well known, is a driving mechanism of a movable contact arm to a closing position (so-called ON position) where the movable contact arm contacts a corresponding stationary contact arm, of movable contact arms and stationary contact arms provided for respective multi-phases(multi-poles) electrical power circuits, an opening position where the movable contact arm is separated from the corresponding stationary contact arm (an OFF position as a manually opened position and an automatically open position in response to a fault current detection (so-called trip position). The switching mechanism includes a trip spring, a plurality of links and levers for transferring an elastic driving force of the trip spring to the movable contact arm, latches for maintaining or releasing an elastic energy-charged state of the trip spring, a switching shaft (so-called a main shaft) connected to each of the three-phases circuits for driving the three movable contact arms for the three poles to the closing position or the opening position at the same time.

The trip mechanism is a mechanism for triggering the switching mechanism to a trip position in response to a trip control signal from the controller.

Here, the trip mechanism does not provide a driving force to the switching mechanism to drive to the trip position, but operates to release the latches to output a driving force for a trip operation by releasing the trip spring of the switching mechanism to discharge the charged elastic energy. Thus, the term 'trigger' is used.

The trip mechanism includes a coil magnetized by the trip control signal from the controller to generate a magnetic force, a trip bar movable in response to magnetization or demagnetization of the corresponding coil, and the like.

The low voltage circuit breaker with the large capacity may further include an Under Voltage Trip (UVT) mechanism for triggering the switching mechanism to the trip position when a voltage on the electrical power circuit is lowered below a predetermined normal reference voltage, or a shunt trip mechanism for triggering the switching mechanism to the trip position in response to a remote trip control signal from a remote monitoring center.

The controller may be configured as an overcurrent relay (abbreviated as OCR hereinafter), especially, a digital OCR for detecting a fault current on the electrical power circuit and outputting a trip control signal upon detection of the fault current.

The OCR is a device capable of providing and displaying various information, such as simply detecting an occurrence of a fault current on a circuit, outputting a control signal, calculating various status information related to the circuit, calculating a fault-occurred position on the circuit, and the like. The OCR is a control and information monitoring device having a microprocessor and a display capable of processing, calculating and displaying various information.

The auxiliary mechanism includes an Auxiliary Switch (AX) for outputting a signal indicating a closing or opening position, namely, an On or OFF position, of a circuit breaker, and an Alarm Switch (AL) for outputting a signal indicating that the circuit breaker has been tripped.

In the low voltage circuit breaker with the large capacity provided by the applicant of this disclosure, the AX and the AL of the auxiliary mechanism, the trip mechanism, and the under voltage trip mechanism or shunt trip mechanism interlocking with the trip mechanism are arranged dispersedly. This results in requiring a longer time for assembling, testing and producing those components.

Also, in the low voltage circuit breaker with the large capacity, testing for a normal or abnormal operation with respect to each of the AX and the AL of the auxiliary mechanism, the trip mechanism, and the under voltage trip mechanism or shunt trip mechanism should be performed after completely assembling them. Consequently, a long time is required and an entire circuit breaker should be disassembled to find a cause of defect upon occurrence of such defect.

SUMMARY OF THE INVENTION

Therefore, to overcome the drawbacks of the related art, a first aspect of the present disclosure is to provide an apparatus of modular trip mechanism and auxiliary mechanism for a circuit breaker, capable of reducing an entire size of the circuit breaker by modularizing an auxiliary mechanism, a trip mechanism, and an under voltage trip device or shunt trip device, and reducing a time taken by assembling, testing and producing those components.

A second aspect of the present disclosure is to provide an apparatus of modular trip mechanism and auxiliary mechanism for a circuit breaker capable of testing whether or not each of an auxiliary mechanism module, a trip mechanism and an under voltage trip device or shunt trip device interlocking with the trip mechanism are normally operating prior to assembling them.

A third aspect of the present disclosure is to provide an apparatus of modular trip mechanism and auxiliary mechanism for a circuit breaker, capable of further improving productivity, in view of size-reduction, assembly, testing and production of the circuit breaker, by making an under voltage trip device or shunt trip device be interlocked with a trip mechanism and configuring the under voltage trip device or shunt trip device and the trip mechanism into one module.

The first aspect of the present disclosure may be achieved by providing an apparatus of modular trip mechanism and auxiliary mechanism for a circuit breaker in accordance with the present disclosure, the circuit breaker having a switching shaft for simultaneously opening or closing three pole electrical power circuits and an overcurrent relay as a controller, the apparatus comprising:

an auxiliary mechanism module including a first micro switch to output an electrical signal indicating an ON or OFF position of the circuit breaker, a first shaft contact lever mechanism rotatable to operate the first micro switch by contacting the switching shaft or receiving an artificial pressing force for testing a normal or abnormal operation, a second micro switch to output an electrical signal indicating whether or not a trip operation of the circuit breaker has been performed, and a second lever rotatable to operate the second micro switch by contacting the switching shaft or receiving an artificial pressing force for testing a normal or abnormal operation; and a trip mechanism module including an electromagnetic trip device having a trip bar as an output unit so as to operate the trip bar to trigger the circuit breaker to a trip position in response to a trip control signal from the overcurrent relay or a test trip control signal from a test signal generating source.

To achieve the second aspect of the present disclosure, the trip mechanism module may further include lead wires for receiving a test signal for an operation test.

To achieve the second aspect of the present disclosure, the first shaft contact lever mechanism may include a first lever to receive a contact and pushing force from the switching shaft or an artificial contact pressing force for testing, the first lever rotatable with receiving a lever rotation shaft, a rolling plate connected to the first lever and rolled in response to rotation of the first lever, a rolling shaft to rollably support the rolling plate, and a first switch driving protrusion protruding upwardly from one side of the rolling plate to operate the first micro switch, and the second lever may include a central shaft receiving portion to receive the lever rotation shaft therein, a first extending portion inclinedly extending upwardly from the shaft receiving portion to receive a contact and pushing force from the switching shaft or an artificial pressing force for testing, and a second extending portion extending from the shaft receiving portion in an opposite direction to the first extending portion to operate the second micro switch. Accordingly, the first and second levers may be artificially pushed to test whether or not the first and second micro switches are normally operating.

To achieve the third aspect of the present disclosure, the trip mechanism module may further include a sub trip mechanism to output a mechanical trip signal by protruding the output pin due to an electromagnetic force, the sub trip mechanism including an under voltage trip device for outputting the mechanical trip signal when a voltage of a control power source or a voltage of the electrical power circuit is lowered below a predetermined reference voltage or a shunt trip device for outputting the mechanical trip signal when receiving a remote control signal, and a interlock lever having a power receiving portion installed at one side thereof to face the output pin so as to be contactable with the protruded output pin, the interlock lever being linearly moved in response to being pressed by the output pin to trigger the trip mechanism module.

In one aspect of the present disclosure, the apparatus may further include a supporting base having a shape of a container with an open upper surface, the supporting base containing the auxiliary mechanism module and the trip mechanism module in one side and another side thereof.

In another aspect of the present disclosure, the supporting base may include a plurality of partitions to define areas for containing and supporting components without great shaking, the components configuring the auxiliary mechanism module and the trip mechanism module, respectively.

In another aspect of the present disclosure, the apparatus may further include return springs contactable with the first lever and the second lever to return the first and second levers to original positions thereof when the force pushing the first lever and the second lever is disappeared.

In another aspect of the present disclosure, the trip mechanism module may further include a sub trip mechanism to output a mechanical trip signal by protruding the output pin, the sub trip mechanism including an under voltage trip device for outputting the mechanical trip signal when a voltage on a control power source or an electrical power circuit is lowered below a predetermined reference voltage or a shunt trip device for outputting the mechanical trip signal when receiving a remote control signal, and a interlock lever having a power receiving portion installed at one side thereof to face the output pin so as to be contactable with the protruded output pin, the interlock lever being linearly moved in response to being pressed by the output pin to trigger the trip mechanism module.

In another aspect of the present disclosure, the apparatus may further include connectors having a plurality of pins or pin holes connected to the lead wires to receive the test signal.

Further scope of applicability of the present application will become more apparent from the present disclosure given hereinafter. However, it should be understood that the present disclosure and specific examples, while indicating preferred embodiments of the invention, are given by way of illustration only, since various changes and modifications within the spirit and scope of the invention will become apparent to those skilled in the art from the present disclosure.

BRIEF DESCRIPTION OF THE DRAWINGS

The accompanying drawings, which are included to provide a further understanding of the invention and are incorporated in and constitute a part of this disclosure, illustrate exemplary embodiments and together with the description serve to explain the principles of the invention.

In the drawings.

PRESENT DISCLOSURE OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
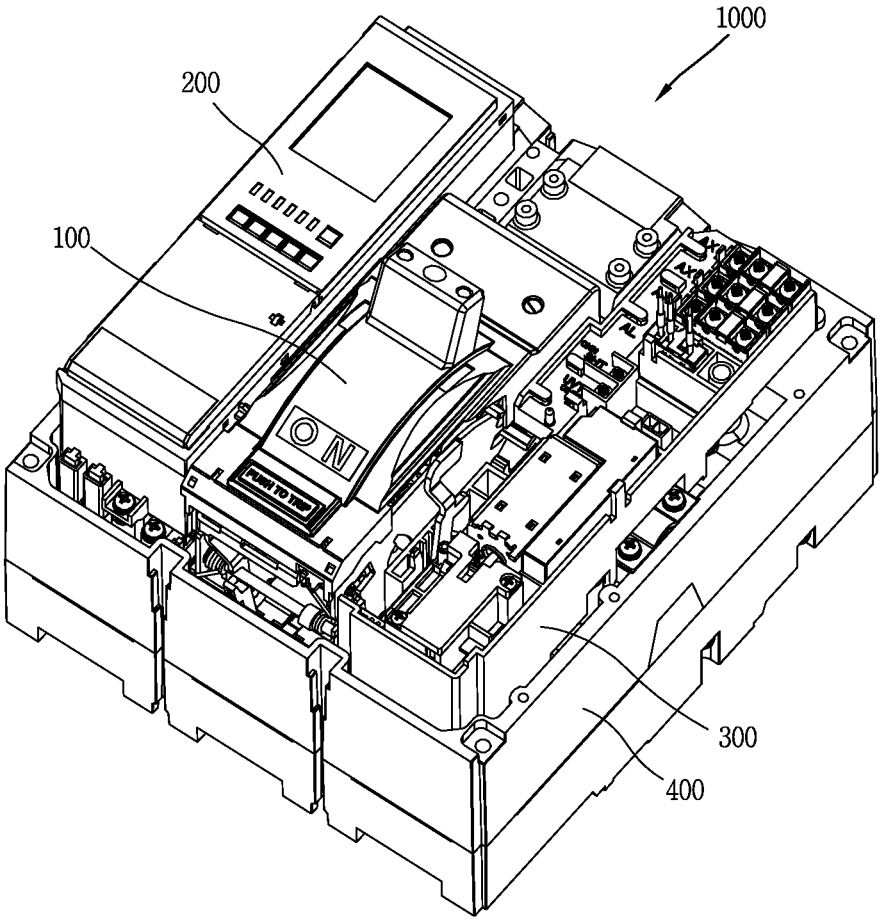
FIG. 1 is a perspective view showing a circuit breaker having an apparatus of modular trip mechanism and auxiliary mechanism assembled thereto in accordance with a preferred embodiment of the present disclosure.

FIG. 1 is a perspective view showing a circuit breaker having an apparatus of modular trip mechanism and auxiliary mechanism assembled thereto in accordance with a preferred embodiment of the present disclosure. As shown in FIG. 1, a circuit breaker 1000 according to a preferred embodiment may include a switching mechanism 100, an overcurrent relay (OCR) 200, an apparatus 300 of modularized trip mechanism and auxiliary mechanism, and a main cover 400.

The switching mechanism 100, as well known, is a driving mechanism to a closing position where a movable contact arm contacts a corresponding stationary contact arm, of movable contact arm and stationary contact arms provided for each of three-phases electrical power circuits or an opening position (so-called trip position) where the movable contact arm is separated from the corresponding stationary contact arm. The switching mechanism may include a switching spring, a plurality of links and levers for transferring an elastic driving force of the switching spring to the movable contact arms, latches for maintaining or releasing an elastic energy-charged state of the switching spring, a switching shaft (see 500 in FIG. 7) commonly connected to each of three-phases circuits for driving the three movable contact arms for the three poles to the closing position or the opening position at the same time.

Figure 7:
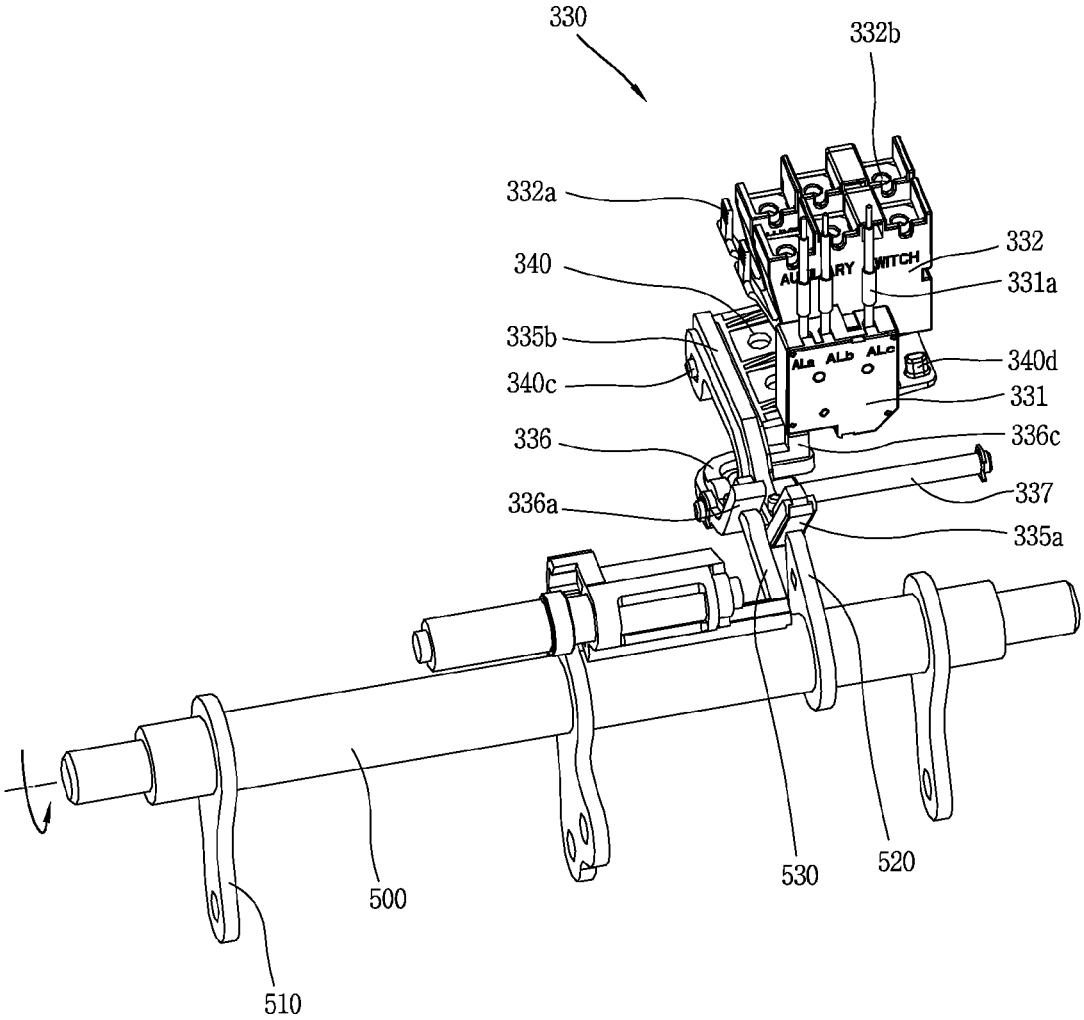
FIG. 7 is a perspective view showing a interlock configuration between the auxiliary mechanism module and a switching shaft.

The switching shaft 500, as shown in FIG. 7, may be a shaft in a shape of a long bar. The switching shaft 500 may include three driving links 510 installed on the shaft 500 to be operably connected to respective three-phases movable contact arms (not shown) so as to open or close corresponding three-phases circuits, respectively, a first lever pressing lever 520 installed on the switching shaft 500 to push a first lever 335 to be explained later, and a second lever pressing lever 530 installed on the switching shaft 500 to push a second lever 336 to be explained later.

The OCR 200 is a controller to detect a fault current on the three-phases circuits (hereinafter abbreviated as circuit) and output a trip control signal upon detection of the fault current. The OCR 200 may be configured by a digital OCR in which various input signals including a detection signal of a fault current such as an overcurrent or a short-circuit current on the circuit are converted into digital signals to be processed by a microprocessor and digital output signals including a trip control signal are output by the microprocessor.

The main cover 400 defines an enclosure of the circuit breaker 1000, and may accommodate therein the switching mechanism 100, the OCR 200, and the apparatus 300 of modularized trip mechanism and auxiliary mechanism.

Hereinafter, description will be given of configuration and operation of the apparatus 300 of modularized trip mechanism and auxiliary mechanism, with reference to FIGS. 2 to 7.

Figure 2:
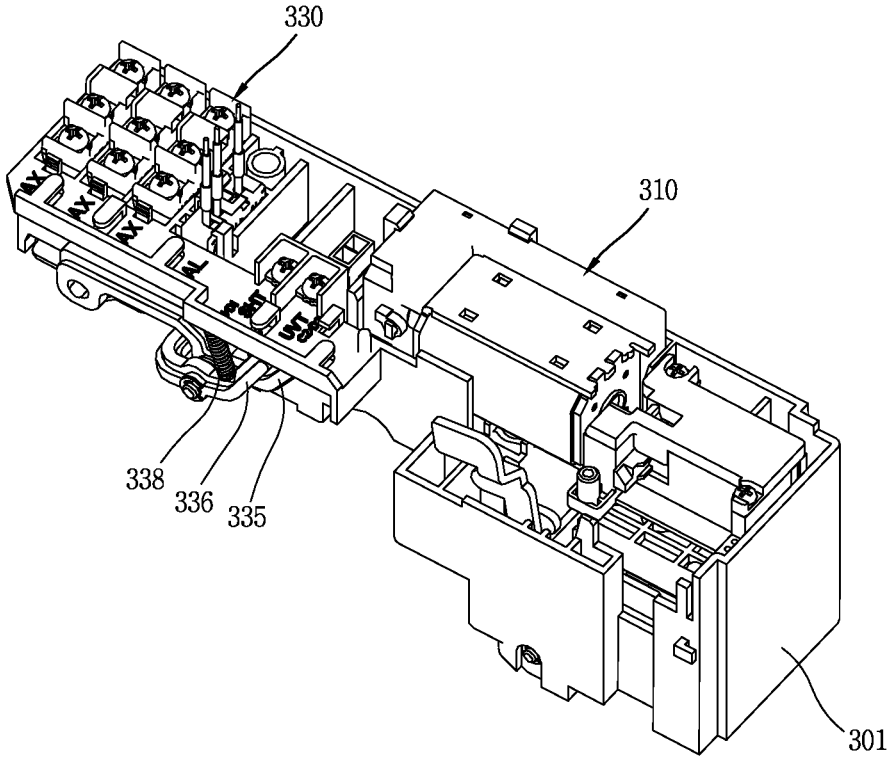
FIG. 2 is a perspective view showing an appearance of an assembly of a trip mechanism module, an auxiliary mechanism module and a supporting base in accordance with a preferred embodiment of the present disclosure.

As shown in FIG. 2, the apparatus 300 of modularized trip mechanism and auxiliary mechanism may include an auxiliary mechanism module 330, and a trip mechanism module 310, and further include a supporting base 301.

Figure 4:
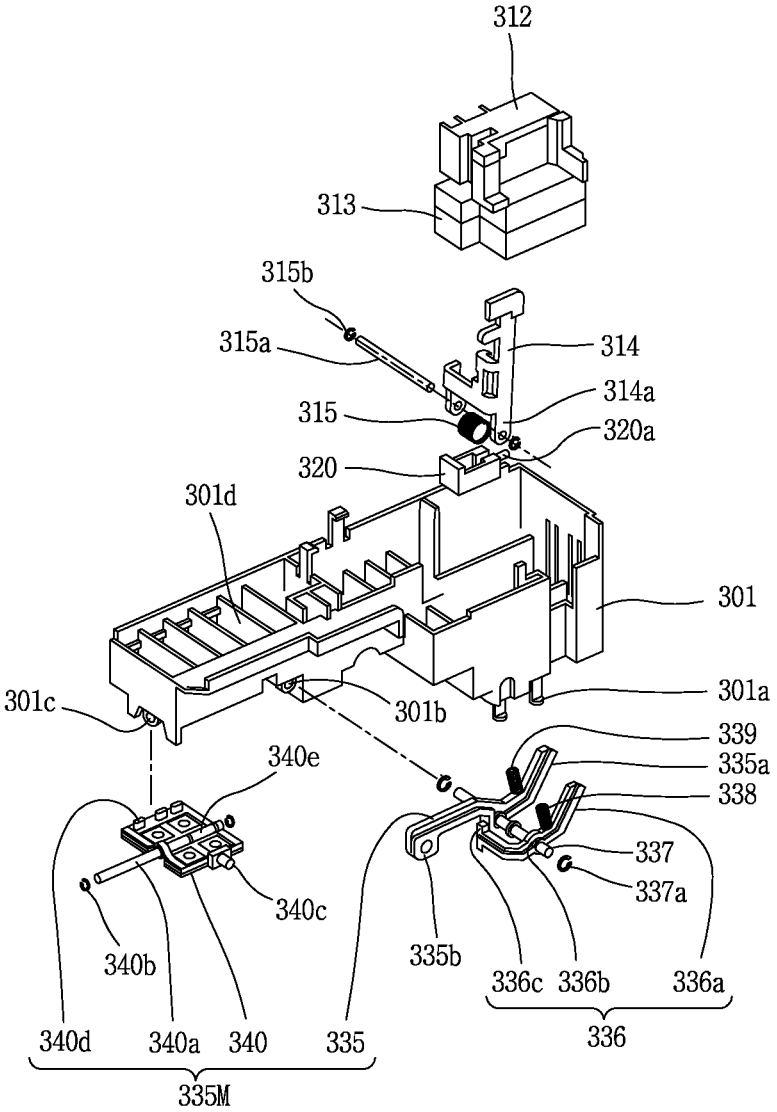
FIG. 4 is a exploded perspective view showing the supporting base, a trip mechanism, and a lever mechanism of the auxiliary mechanism module of the apparatus of modular trip mechanism and auxiliary mechanism in accordance with a preferred embodiment of the present disclosure.

Referring to FIG. 2 or FIG. 4, the supporting base 301 may be configured as a member in a shape of a rectangular container having an open upper surface, and accommodate the auxiliary mechanism module 330 and a trip mechanism module 310 at one side and another side therein. That is, in the drawing, the auxiliary mechanism module 330 may be accommodated at a left side within the supporting base 301, and the trip mechanism module 310 may be accommodated at a right side within the supporting base 301.

To accommodate components included in each of the auxiliary mechanism module 330 and the trip mechanism module 310 and support those components without great shaking (movement), the supporting base 301 may include a plurality of partitions 301*d* for forming areas for accommodating those components therein with leaving only an allowable tolerance required for assembling.

Especially, a contact lever (not shown) for obtaining a mechanical driving force for opening or closing a switch in a contact manner may downwardly extend from a first micro switch 332 and a second micro switch 331, which will be explained later, in order to allow for the downward extension of the contact lever, the supporting base 301 may have an opening portion (not shown) at a lower surface of a left side therein.

In order to receive a lever rotation shaft 337 and a rolling shaft 340*a* to be explained later, the supporting base 301 may include shaft receiving opening portions 301*b* and 301*c* protruding downwardly from the lower surface.

Also, in order to assembly the supporting base 301 to be firmly located at the main cover 400, which defines the enclosure of the circuit breaker 100 of FIG. 1, the supporting base 301 may include a plurality of elastic supporting pieces 301*a*, as shown in FIG. 4.

The main cover 400 may include jaw portions (not shown) protruding from an inner wall surface of the main cover 400 to correspond to the elastic supporting pieces 301*a*. Accordingly, the elastic supporting pieces 301*a* may be elastically supported on lower surfaces of the corresponding jaw portions, which may allow the supporting base 301 to be mounted onto the main cover 400 without movement.

Hereinafter, description will be given of configuration and operation of the auxiliary mechanism module 330 with reference to FIG. 3, FIG. 4 and FIG. 7.

The auxiliary mechanism module 330 may include a first micro switch 332, a first shaft contact lever mechanism 335M, a second micro switch 331, and a second lever 336.

The first micro switch 332 is a micro switch for outputting an electrical signal indicating an ON or OFF position of the circuit breaker, and may generate an electrical output signal in response to a mechanical contact, as well known.

To this end, the first micro switch 332 may include input terminals 332*a* for receiving a predetermined input signal, for example, a Direct-Current (DC) voltage signal, inner switch contacts (not shown), output terminals 332*b*, and a contact lever (not shown), which downwardly extends from a lower portion of the first micro switch 332 in an inclined state and has a roller at an end portion according to a preferred embodiment, so as to obtain a mechanical driving force for driving the inner switch contacts to an opening or closing position.

The first shaft contact lever mechanism 335M (FIG. 4) is a rotatable mechanism, which contacts a switching shaft 500 (see FIG. 7) to operate the first micro switch 332.

The first shaft contact lever mechanism 335M may include a first lever 335, a rolling plate 340, a rolling shaft 340*a*, and a first switch driving protrusion 340*d*. The first shaft contact lever mechanism 335M may further include a connection protrusion 340*c* for connecting the rolling plate 340 to the first lever 335.

The first lever 335 may receive a contact and pushing force from the switching shaft 500 as shown in FIG. 7 or an artificial contact pressing force, as if a user manually pushes with a hand for testing. The first lever 335 may be rotatable with being disposed on the lever rotation shaft 337.

The first lever 335, as well shown in FIG. 4, may include a central shaft receiving portion (no reference numeral given) for receiving the lever rotation shaft 337 therein, a first extending portion 335*a* inclinedly extending upwardly from the corresponding shaft receiving portion so as to receive a contact pressing force from the switching shaft 500 (more particularly, from the first lever pressing lever 520 of FIG. 7) or an artificial contact pressure force from the user, and a second extending portion (no reference numeral given) extending from the central shaft receiving portion in an opposite direction to the first extending portion 335*a* and having an end portion provided with a connection hole portion 335*b* in which a connection protrusion 340*c* to be explained later is inserted.

Still referring to FIG. 4, the rolling plate 340 may be connected to the first lever 335 by virtue of connection between the connection protrusion 340*c* and the connection hole portion 335*b*. The rolling plate 340 is a component which is rolled like a seesaw based on the rolling shaft 340*a* in response to the rotation of the first lever 335.

The rolling plate 340 may be configured by coupling a pair of symmetrical plates to face each other, so as to be rollable based on the rolling shaft 340*a*. Each of the plates coupled to each other may have a shaft receiving portion 340*e* at a central portion thereof. The shaft receiving portions 340*e* may have an inner wall surface formed in a shape of a semi-circular groove, respectively. The semi-circular grooves of the shaft receiving portions 340*e* may be coupled to define a shaft receiving opening for allowing the rolling shaft 340*a* to be inserted therethrough.

The rolling plate 340 may be divided, based on the rolling shaft 340*a*, into a first half part where the first switch driving protrusion 340*d* is located and a second half part where the connection protrusion 340*c* is located. When the second half part is moved down, the first half part is moved up, and if the second half part is moved up, the first half part is moved down.

Here, as the first half part is moved up, the first switch driving protrusion 340*d* is moved up to press the contact lever. Accordingly, the first micro switch 332 may output an electrical signal indicating an ON or OFF position of the circuit breaker.

Also, as the first half part is moved down, the first switch driving protrusion 340*d* is moved down to be separated from the contact lever. Accordingly, the first micro switch 332 may not output an electrical signal indicating the ON or OFF position of the circuit breaker.

The rolling shaft 340*a* is a component for rollably supporting the rolling plate 340. The rolling shaft 340*a* may have a shape of a long bar, and a pair of O-rings 340*b* may be installed at both lengthwise end portions thereof.

The pair of O-rings 340*b* may prevent the rolling shaft 340*a* from being separated from the shaft receiving portion 340*e* in an axial direction, and be installed by being inserted into installation recesses (not shown) formed at the both lengthwise end portions of the rolling shaft 340*a*.

The rolling shaft 340*a* may be supported by being inserted into the shaft receiving opening portion 301*c* of the supporting base 301.

The first switch driving protrusion 340*d*, as shown in FIG. 4, may protrude upwardly from one side of the rolling plate 340, so as to operate the first micro switch 332 shown in FIG. 7.

The first switch driving protrusion 340*d* may integrally extend from the rolling plate 340. In accordance with other embodiment, the first switch driving protrusion 340*d* may be separately prepared and coupled onto the rolling plate 340 by welding or using a screw.

The connection protrusion 340*c*, as shown in FIG. 4, may extend from one side surface of the rolling plate 340 to the front (to a right side in FIG. 4). In accordance with one variation, the connection protrusion 340*c* may be separately prepared and coupled onto one side surface (on a right surface in the drawing) of the rolling plate 340 by welding or using a screw.

The connection protrusion 340*c* may be operably inserted into the connection hole portion 335*b* of the first lever 335.

The second micro switch 331 is a component for outputting an electrical signal indicating whether or not the circuit breaker has been tripped.

The second micro switch 331, as well known, may generate the electrical output signal in response to a mechanical contact.

To this end, the second micro switch 331 may include input terminals (not shown) for receiving an input signal such as a predetermined DC voltage signal, inner switch contacts (not shown), output terminals 331*a*, and a contact lever (not shown), which downwardly extends from a lower portion of the second micro switch 331 in an inclined state and has a roller at an end portion according to a preferred embodiment so as to obtain a mechanical driving force for driving the inner switch contacts to an opening or closing position.

Hereinafter, description will be given with reference to FIG. 7 or FIG. 4.

The second lever 336 may contact the switching shaft 500 and be rotatable to operate the second micro switch 331.

The second lever 336 may include a shaft receiving portion 336*b* formed at a middle thereof to receive the lever rotation shaft 337 therein, a first extending portion 336*a* inclinedly extending upwardly from the corresponding shaft receiving portion 336*b* to receive a contact pressing force from the switching shaft 500 (more particularly, from the second lever pressing lever 530 of FIG. 7) or an artificial contact pressure force from a user, and a second extending portion 336*c* extending from the shaft receiving portion 336*b* in an opposite direction to the first extending portion 336*a* so as to operate the second micro switch 331.

Especially, the second extending portion 336*c* may have an operation protrusion protruding from a free end portion thereof in a longitudinal direction, so as to press the contact lever of the second micro switch 331.

The pair of O-rings 337*a* may be fixed to installation grooves (not shown), which are formed at both lengthwise end portions of the lever rotation shaft 337, to prevent the first lever 335 and the second lever 336 from being separated in an axial direction.

A pair of O-rings 337*a* may be fixed onto installation recesses (not shown) formed at both lengthwise end portions of the lever rotation shaft 337 so as to prevent an axial separation of the first lever 335 and the second lever 336.

Figure 3:
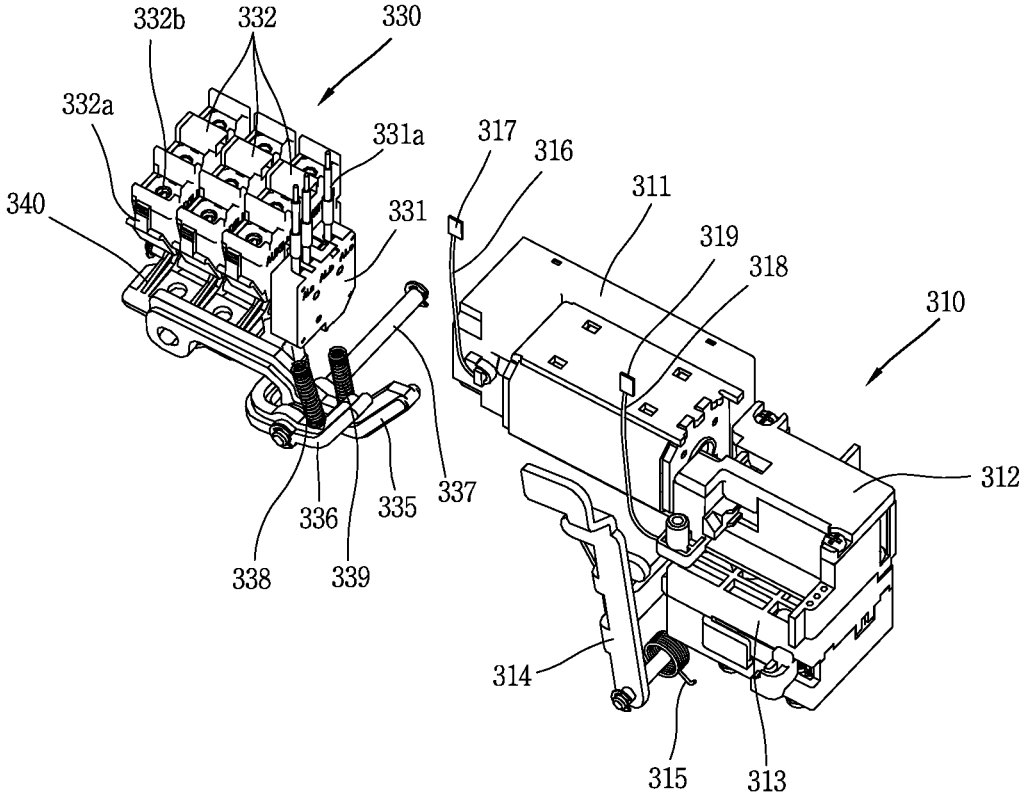
FIG. 3 is a perspective view showing each of the trip mechanism module and the auxiliary mechanism module in accordance with a preferred embodiment of the present disclosure.

Referring to FIGS. 3 and 4, the auxiliary mechanism module 330 may further include return springs 338 and 339.

The return springs 338 and 339 may include a first return spring 339 and a second return spring 338. The first and second return springs 339 and 338 are components for applying elastic forces to the first lever 335 and the second lever 336 to make the first lever 335 and the second lever 336 moved back to their initial positions when pushing forces are not applied to the first and second levers 335 and 336 any more.

Each of the first and second return springs 339 and 338 may have one end portion supported by a spring supporting protrusion (not shown) formed at an upper surface of the first or second lever 335 or 336, and another end portion supported by a spring supporting protrusion (not shown) formed at a low surface of one side of the supporting base 301.

FIG. 2 shows a state that the second return spring 338 is installed at the lower surface of the one side of the supporting base 301.

Hereinafter, description will be given of configuration and operation of the trip mechanism module 310 with reference to FIGS. 3 to 6.

The trip mechanism module 310 may include an electromagnetic trip device (so called MTD) 321.

In accordance with the preferred embodiment of the present disclosure, the electromagnetic trip device 321 may further include a reset mechanism for resetting the electromagnetic trip device 321 to an original position after triggering the circuit breaker to a trip operation.

The electromagnetic trip device 321 may include an electromagnet unit, a latch 325, and a trip bar mechanism 313.

Here, the electromagnet unit may include a coil (not shown) magnetized by a trip control signal (so-called trip command signal) from the OCR 200 of FIG. 1, a bobbin (no reference numeral given) wound with the coil, a movable core 322, a bias spring 323 and a permanent magnet (not shown) for providing a magnetic force to attract the movable core 322.

The movable core 322 may be configured by an iron core, which is linearly moved back and forth as the coil of the electromagnet unit is magnetized or demagnetized.

The bias spring 323 may be installed between the bobbin and the movable core 322 to apply an elastic force upon the movable core 322 in a forth moving direction.

With the configuration, when the coil is magnetized by the trip control signal sent from the OCR 200, a magnetic attractive force of the permanent magnet is offset. Accordingly, the bias spring 323 applies an elastic force to the movable core 322, which thus moves forward.

Figure 6:
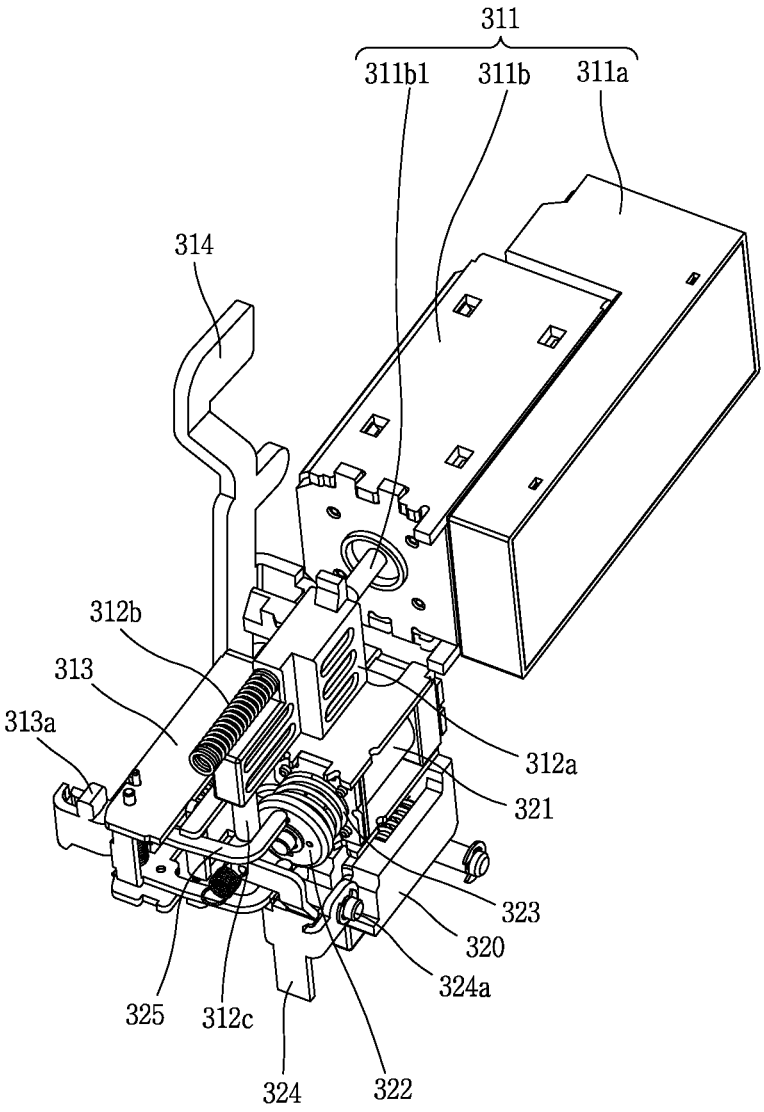
FIG. 6 is a perspective view showing the trip mechanism module including the shunt trip device or under voltage trip device and a interlock lever mechanism in accordance with a preferred embodiment of the present disclosure.

Referring to FIG. 6, the latch 325 may include one end portion as a free end portion located to face the movable core 322, an intermediate portion rotatably supported by a rotation shaft (no reference numeral given) on an enclosure of the trip bar mechanism 313 to be explained later, and another end portion rotatable to a locking or releasing position for a trip bar 313*a* of the trip bar mechanism 313 in response to the movable core 322 being moved back and forth.

The latch 325 may be configured by a pair of levers in an approximately U-like shape, as shown in FIG. 6.

The trip bar mechanism 313 may include a trip bar 313*a* linearly movable to a position for triggering the circuit breaker, especially, the switching mechanism of the circuit breaker to a trip position, an enclosure (no reference numeral given) for guiding and supporting a linear movement of the trip bar 313*a*, and a spring 313*c* (see FIG. 5) having one end supported by the enclosure and another end connected to the trip bar 313*a* to elastically pull the trip bar 313*a* to the trigger position.

The trip bar 313*a* may include a reset plate contact portion 313*b* connected to or integrally formed with the trip bar 313*a* and pressed by a reset plate 314 to be explained later.

The trip bar 313*a* of the trip bar mechanism 313 may include a stopping jaw (not shown) stopped by the another end of the latch 325. The trip bar 313*a* may be released from the latch 325 or restricted by the latch 325 according to whether the latch 325 is rotated in response to the movable core 322 being moved back or forth. That is, when the latch 325 is rotated, the trip bar 313*a* may be released from the latch 325. Simultaneously, the spring 313*c* is contracted to pull the trip bar 313*a*. The trip bar 313*a* is thus moved to the trigger position.

When the latch 325 is not rotated, the trip bar 313*a* is locked by the another end of the latch 325 and the spring 313*c* is maintained in a tensioned state.

The reset mechanism for resetting the electromagnetic trip device 321 to the original position may include a reset plate 314, a return spring 315, a pin assembly 320, a reset operation plate 324, and an operation plate supporting shaft 324*a*.

The reset plate 314 may include a trip bar pressing portion 314*b* contactable with the reset plate contact portion 313*b* to press reset plate contact portion 313*b*, and a pin assembly pressing portion 314*c* protruding toward the pin assembly 320 to press the pin assembly 320 toward the reset operation plate 324.

The reset plate 314 may have a pair of shaft receiving portions 314*a* at a lower portion thereof so as to be rotatably supported by a reset plate rotation supporting shaft 315*a* inserted into the pair of shaft receiving portions 314*a*.

Referring to FIG. 4, to prevent the reset plate 314 from being separated from the reset plate rotation supporting shaft 315*a* in an axial direction, recesses (not shown) may be formed at both lengthwise end portions of the reset plate rotation supporting shaft 315*a*, and a pair of O-rings 315*b* for preventing the axial separation of the reset plate 314 may be installed in the corresponding recesses.

The return spring 315, as shown in FIG. 3 or FIG. 4, may be configured by a torsion spring which has one end inserted into the reset plate rotation supporting shaft 315*a* and another end inserted into the reset plate 314. When a reset manipulation force, which is applied by a user to manipulate a handle (no reference numeral given) included in the switching mechanism 100 to an OFF position, the return spring 315 may elastically press the reset plate 314 to be rotated in a clockwise direction in FIG. 5. Accordingly, the reset plate 314 may be moved back to the initial position where it is located apart from the pin assembly 320 and the reset plate contact portion 313*b* of the trip bar mechanism 313.

Figure 5:
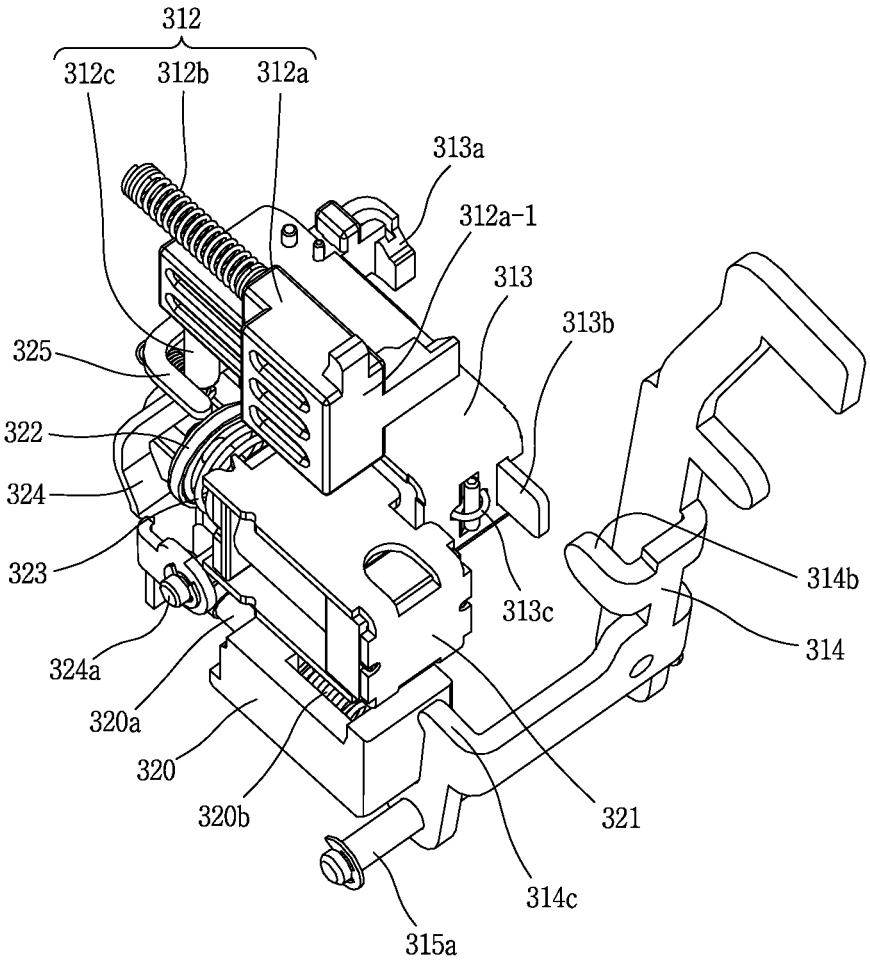
FIG. 5 is a perspective view showing the trip mechanism module excluding a shunt trip device and an under voltage trip device in accordance with a preferred embodiment of the present disclosure.

As shown in FIG. 4 or FIG. 5, the pin assembly 320 may include an enclosure supported and slidably guided by the supporting base 301, a pin portion 320*a* supported by the enclosure and protruding from the enclosure toward the reset operation plate 324, and a spring 320*b* installed inside the enclosure to elastically press the pin portion 320*a* so as to protrude toward the reset operation plate 324.

As shown in FIGS. 5 and 6, the reset operation plate 324 may include a lower power receiving portion rotatably supported by the operation plate supporting shaft 324*a* and receiving a rotating force from the pin portion 320*a* of the pin assembly 320, and an upper operating portion for pressing the movable core 322 of the electromagnetic trip device 321 to an initial position when the lower power receiving portion is rotated by being pressed by the pin portion 320*a*.

A return spring (no reference numeral given) for returning the reset operation plate 324 may be installed between the reset operation plate 324 and the latch 325, so as to apply an elastic force to the reset operation plate 324, which has performed a reset operation, to the initial position.

The operation plate supporting shaft 324*a* may rotatably support the reset operation plate 324.

Hereinafter, description will be given of a reset operation of the reset mechanism in accordance with the preferred embodiment for returning the electromagnetic trip device 321 to an original position.

Upon a reset operation of the circuit breaker 1000 shown in FIG. 1, namely, when a user manipulates the handle of the switching mechanism 100 to an OFF position, then in interlocking with the handle, the reset plate 314 shown in FIG. 5 is rotated in a counterclockwise direction in FIG. 5 based on the reset plate rotation supporting shaft 315*a* to push the pin assembly 320 toward the reset operation plate 324 and simultaneously press the reset plate contact portion 313*b* of the trip bar mechanism 313.

Accordingly, as shown in FIG. 5, the trip bar 313*a* pressed by the reset plate contact portion 313*b* is moved back from the trigger position so that the stopping jaw (not shown) of the trip bar 313*a* can be locked by the another end of the latch 325. Simultaneously, as the trip bar 313*a* is moved back, the spring 313*c* whose one end is supported by the trip bar 313*a* is tensioned and restricted with being charged with elastic energy.

At the same time, when the pin portion 320*a* of the pin assembly 320 shown in FIG. 5 pushes a lower portion of the reset operation plate 324, the reset operation plate 324 is rotated in a clockwise direction in the drawing based on the operation plate supporting shaft 324*a*. The movable core 322 is then pushed by an upper portion of the reset operation plate 324 to be moved back to the initial position.

After the reset operation, the reset operation plate 324 is returned to the initial position by the return spring, which is installed between the reset operation plate 324 and the latch 325 for making the reset operation plate 324 be moved back to the initial position.

Referring to FIG. 6 or FIG. 5, the trip mechanism module 310 may further include an Under Voltage Trip (abbreviated as UVT hereinafter) device or shunt trip device 311, and a interlock lever mechanism 312.

The UVT device or shunt trip device 311, as shown in FIG. 6, may include a sub trip mechanism 311*b* configured by an UVT device or a shunt trip device, and a printed circuit board 311*a* for receiving and transferring a magnetization or demagnetization control signal of a coil of the sub trip mechanism 311*b* to be explained later.

The sub trip mechanism 311*b* may be selectively configured by an UVT device. When the sub trip mechanism 311*b* is the UVT device, the UVT device may be configured by an electromagnetic actuator, which is driven by a control signal, which is received and transferred by the printed circuit board 311*a* from the OCR 200 of FIG. 1, which detects a state when a voltage on the electrical power circuit connected with the circuit breaker 1000 or a voltage of a control power source is lowered below a predetermined reference voltage.

The electromagnetic actuator, as well known, may include a stationary core (not shown), a movable core movable to a position close to the stationary core and a position apart from the stationary core, an output pin 311*b*1 formed by a part of the movable core, a permanent magnet (not shown) for providing a magnetic force to attract the movable core toward the stationary core, a coil (not shown) installed around the stationary core and magnetized together with the stationary core by the control signal to generate a magnetic force for offsetting the magnetic force of the permanent magnet, and a spring for elastically pressing the movable core to be apart from the stationary core when the magnetic force of the permanent magnet is offset.

An inner configuration of the electromagnetic actuator is well known, so disclosure thereof by the drawing will be omitted.

The sub trip mechanism 311*b* may be selectively configured by a shunt trip device. When the sub trip mechanism 311*b* is the shunt trip device, the corresponding shunt trip device may be configured by an electromagnetic actuator, which is driven by a control signal sent, for example, from a monitoring console (monitoring system) installed at a remote area from the circuit breaker 1000. Here, the electromagnetic actuator may be configured as the same as the configuration of the electromagnetic actuator configured by the UVT device.

Therefore, when the UVT device or shunt trip device 311 receives a control signal sent, for example, by the OCR 200 of FIG. 1 or a monitoring console installed at a remote area, a magnetic force of the permanent magnet is offset by a magnetic force of the coil and the stationary core magnetized by the control signal, accordingly, the movable core and the output pin 311*b*1 are protruded by an elastic pressing force of the spring.

Referring to FIG. 6, the protruded output pin 311*b*1 then presses a interlock lever 312*a* installed to face the output pin 311*b*1 to make the interlock lever 312*a* linearly moved forward.

The interlock lever mechanism 312 may include a interlock lever 312*a*, a return spring 312*b*, and a latch pressing portion 312*c*. The interlock lever mechanism 312 may be accommodated within an enclosure (no reference numeral given).

The interlock lever 312*a* may include a power receiving portion 312*a*-1 (FIG. 5) installed at one side to face the output pin 311*b*1 so as to be contactable with the output pin 311*b*1 of the protruded UVT device or shunt trip device 311, and a latch pressing portion 312*c* extending from the power receiving portion 312*a*-1 toward the latch 325 of the electromagnetic trip device 321.

The interlock lever 312*a* may be linearly movable in response to being pressed by the output pin 311*b*1 so as to drive the trip mechanism module 310 to the trigger position. In more detail, the interlock lever 312*a* may be linearly moved in response to being pressed by the output pin 311*b*1 to press the latch 325. As the pressed latch 325 is accordingly rotated to release the trip bar 313*a*, the tensioned spring 313*c* pulls the trip bar 313*a* so that the trip bar 313*a* can be moved to the trigger position.

Therefore, the switching mechanism 100 of the circuit breaker 1000 operates to the trip position.

The return spring 312*b* is a component for applying an elastic force to the interlock lever 312*a*, which has been moved to press the latch 325, to be returned to the initial position. One end of the return spring 312*b* may be installed around a spring mounting protrusion (not shown) formed at a surface opposite to a surface of the interlock lever 312*a*, which faces the output pin 311*b*1, and the other end of the return spring 312*b* may be supported by a wall surface of the enclosure of the interlock lever mechanism 312.

The latch pressing portion 312*c* may be connected to the interlock lever 312*a* or integrally extend from the interlock lever 312*a*. The latch pressing portion 312*c* may face the latch 325 to press the latch 325 when being linearly moved in response to being pressed by the output pin 311*b*1.

The trip mechanism module 310, as shown in FIG. 3, may further include lead wires 316 and 318 for receiving test signals for allowing an operation test. Here, a component for outputting the test signal may be implemented by any signal generating source, which can output a voltage signal having a predetermined level.

The lead wires 316 and 318 may include a lead wire 316 for providing a transfer path of a remote trip control signal from a remote area or a test signal for testing whether or not the UVT device or shunt trip device 311 is operating in a normal state, and a lead wire 318 for providing a transfer path of a trip control signal from the OCR 200 or a test signal for testing whether or not the electromagnetic trip device 321 is operating in a normal state.

The trip mechanism module 310, as shown in FIG. 3, may further include connectors 317 and 319 having a plurality of pins or pin holes connected to the lead wires 316 and 318 for receiving the remote trip control signal, the trip control signal or the test signal.

The connectors 317 and 319 may include a connector 317 for allowing reception of the remote trip control signal from the remote area or the test signal for testing whether or not the UVT device or shunt trip device 311 is operating in the normal state, and a connector 319 for allowing reception of the trip control signal from the OCR 200 or the test signal for testing whether or not the electromagnetic trip device 321 is operating in the normal state.

When the corresponding remote trip control signal or test signal is received by the printed circuit board 311*a* of the UVT device or shunt trip device 311 from the remote control monitoring console or a (test) signal generating source via the connector 317 and the lead wire 316, in the normal state of the UVT device or shunt trip device 311, the magnetic force of the permanent magnet is offset by the magnetic force of the coil and the stationary core magnetized by the control signal transferred from the printed circuit board 311*a*. Accordingly, the output pin 311*b*1 is protruded by the elastic pressing force of the spring.

When the UVT device or shunt trip device 311 is in an abnormal state (a defective state), the output pin 311*b*1 may not be protruded. When the trip control signal from the OCR 200 or the test signal from the (test) signal generating source is received on the coil of the electromagnetic trip device 321 via the connector 319 and the lead wire 318, in the normal state of the electromagnetic trip device 321, the trip bar 313*a* is released from the latch 325 as the latch 325 is rotated in response to the movable core 322 being moved forward. Simultaneously, the spring 313*c* in a tensioned state is contracted to pull the trip bar 313*a* so as to make the trip bar 313*a* moved.

When the electromagnetic trip device 321 is in an abnormal state (a defective state), the trip bar 313*a* may not be moved. This may allow for checking a normal or abnormal state.

Hereinafter, description will be given of an operation of the apparatus of the modular trip mechanism and auxiliary mechanism for the circuit breaker having the aforementioned configuration with reference to the accompanying drawings.

First, description will be given of test and assembly operations of the apparatus of the modular trip mechanism and auxiliary mechanism for the circuit breaker.

A test operation of the auxiliary mechanism module 330 will now be described. Here, the test operation is performed by targeting only the auxiliary mechanism module 330 prior to assembling.

In order to test whether or not the first micro switch 332 and the first shaft contact lever mechanism 335M of the auxiliary mechanism module 330 are operating in a normal state, after applying a predetermined voltage signal to the input terminal 332*a*, when the first lever 335 is, for example, pushed by a hand to apply an artificial operation condition, the connection hole portion 335*b* of the first lever 335 shown in FIG. 4 moves down.

In turn, the right half part of the rolling plate 340 in FIG. 4 moves down whereas the left half part moves up. Accordingly, the first switch driving protrusion 340*d* located at the left half part moves up.

As the first switch driving protrusion 340*d* moves up, it presses the contact lever of the first micro switch 332 so that contacts within the first micro switch 332 are switched to a closed position, for example. An output signal is thus output via the output terminal 332*b* of the first micro switch 332.

Whether or not the corresponding output signal has been output may be checked by a device, such as a voltmeter or an oscilloscope, which is able to measure a voltage or a voltage waveform through a signal line or the like, thereby checking a normal or abnormal operation of the first micro switch 332 and the first shaft contact lever mechanism 335M. That is, when an output voltage or an output waveform is normally detected, the first micro switch 332 and the first shaft contact lever mechanism 335M may be determined to be normal.

On the contrary, when the output voltage or output waveform is not normally detected, the first micro switch 332 and the first shaft contact lever mechanism 335M may be determined to be defective.

The similar method may be employed to test whether the second micro switch 331 and the second lever 336 of the auxiliary mechanism module 330 are operating in a normal state.

That is, in order to test whether or not the second micro switch 331 and the second lever 336 of the auxiliary mechanism module 330 are operating in a normal state, after applying a predetermined voltage signal to the input terminal (not shown), when the first extending portion 336*a* is, for example, pushed by a hand to apply an artificial operation condition, the second extending portion 336*c* of the second lever 336 shown in FIG. 4 moves down. Accordingly, the contact lever of the second micro switch 331 is pressed.

Accordingly, when the contacts within the first micro switch 332 is switched to, for example, a closed position, an output signal is thusly output via the output terminal 331*a* of the second micro switch 331. Whether or not the corresponding output signal has been output may be checked by a device, such as a voltmeter or an oscilloscope, which is able to measure a voltage or a voltage waveform through a signal line or the like, thereby checking a normal or abnormal operation of the second micro switch 331 and the second lever 336.

That is, when an output voltage or an output waveform is normally detected, the second micro switch 331 and the second lever 336 may be determined to be normal. On the contrary, when the output voltage or output waveform is not normally detected, the second micro switch 331 and the second lever 336 may be determined to be defective.

Hereinafter, a test operation of the trip mechanism module 310 will be described. Here, the test operation is performed by targeting only the trip mechanism module 310 prior to assembling.

A normality test operation for the electromagnetic trip device 321, the latch 325 and the trip bar mechanism 313 of the trip mechanism module 310 shown in FIG. 3 will now be described.

For example, in order to perform an operation test, a voltage signal having a predetermined voltage level, such as a trip control signal from the OCR, is applied as a trip control signal from a signal generator to the electromagnetic trip device 321 via the connector 319.

When the corresponding trip control signal makes the coil of the electromagnetic trip device 321 shown in FIG. 5 magnetized so as to offset the magnetic force of the permanent magnet, the movable core 322 is moved forward by the bias spring 323. As the movable core 322 is moved forward, the latch 325 is pressed to be rotated, thereby releasing the trip bar 313*a*.

The trip bar 313*a* is then moved by an elastic force which is applied as the spring 313*c* pulls the trip bar 313*a* with being contracted.

When the movement of the trip bar 313*a* is shown after applying the artificial trip control signal, the electromagnetic trip device 321, the latch 325 and the trip bar mechanism 313 are determined to be normal.

On the contrary, when the movement of the trip bar 313*a* is not shown after applying the artificial trip control signal, the electromagnetic trip device 321, the latch 325 and the trip bar mechanism 313 are determined to be defective.

Hereinafter, a normality test operation for the UVT device or shunt trip device 311, the interlock lever mechanism 312, the latch 325 and the trip bar mechanism 313 will be described.

For example, in order to perform an operation test, a voltage signal having a predetermined voltage level, such as an under voltage trip control signal from the OCR or a trip control signal from a remote area, is applied as a trip control signal from a signal generator to the UVT device or shunt trip device 311 via the connector 317 of FIG. 3.

When the corresponding trip control signal makes the coil of the sub trip mechanism 311*b* shown in FIG. 6 magnetized so as to offset the magnetic force of the permanent magnet, the output pin 311*b*1 is moved forward by the a spring (not shown).

As the interlock lever 312*a* is moved forward in response to being pressed by the proceeding output pin 311*b*1, the latch 325 is pressed by the latch pressing portion 312*c* of the proceeding interlock lever 312*a*.

The latch 325 is accordingly rotated and the trip bar 313*a* released from the latch 325 is then moved by an elastic force which is applied as the spring 313*c* of FIG. 5 pulls the trip bar 313*a* with being contracted.

When the movement of the trip bar 313*a* is shown after applying the artificial trip control signal, the UVT device or shunt trip device 311, the interlock lever mechanism 312, the latch 325 and the trip bar mechanism 313 are determined to be normal.

On the contrary, when the movement of the trip bar 313*a* is not detected after applying the artificial trip control signal, the UVT device or shunt trip device 311, the interlock lever mechanism 312, the latch 325 and the trip bar mechanism 313 are determined to be defective.

In the apparatus of the modular trip mechanism and auxiliary mechanism for the circuit breaker, the auxiliary mechanism module and the trip mechanism module may be tested as to whether they operates in the normal state prior to being assembled. This may result in reduction of time and costs required for assembling, testing and producing those mechanisms.

Hereinafter, an assembling operation of the apparatus of the modular trip mechanism and auxiliary mechanism for the circuit breaker will be briefly described.

The auxiliary mechanism module 330 and the trip mechanism module 310, which have been checked as operating normally through the test, are prepared.

The supporting base 301 is prepared. The auxiliary mechanism module 330 and the trip mechanism module 310 are assembled on predetermined positions, which are divided by the partitions 301*d* on the supporting base 301 for components of those modules 330 and 310, thereby obtaining an assembly of the supporting base 301, the auxiliary mechanism module 330 and the trip mechanism module 310.

The assembly of the supporting base 301, the auxiliary mechanism module 330 and the trip mechanism module 310 is installed within the main cover 400 of FIG. 1, thereby completing the assembling operation.

Hereinafter, an operation of the auxiliary mechanism module of the apparatus of the modular trip mechanism and auxiliary mechanism for the circuit breaker in the assembled state, with reference to FIG. 7.

As the switching shaft 500 is rotated according to an ON or OFF position of the circuit breaker 1000 in FIG. 7, the first lever pressing lever 520 installed on the switching shaft 500 pushes the first extending portion 335*a* of the first lever 335.

In turn, the connection hole portion 335*b* of the first lever 335 is moved down.

Accordingly, the right half part of the rolling plate 340 shown in FIG. 4 moves down and the left half part moves up. This allows the first switch driving protrusion 340*d* located at the left half part to move up. As moving up, the first switch driving protrusion 340*d* presses the contact lever of the first micro switch 332. When the contacts within the first micro switch 332 is accordingly switched to the closing position, an output signal, which indicates that the circuit breaker 1000 is currently located at the ON or OFF position, is output through the output terminal 332*b* of the first micro switch 332. The corresponding output signal is transferred to the OCR 200 so as to be used for displaying that the circuit breaker is currently located at the ON or OFF position, to be stored in a memory as state information, and/or to be transmitted as state information to a monitoring console located at a remote area.

When the trip operation of the circuit breaker 1000 is performed in FIG. 7, the second lever pressing lever 530, which is installed on the switching shaft 500, pushes the first extending portion 336*a* of the second lever 336 in response to rotation of the switching shaft 500.

Accordingly, the second extending portion 336*c* of FIG. 4 is moved down by the second lever 336, which is rotated based on the lever rotation shaft 337, thereby pressing the contact lever of the second micro switch 331.

When the contacts within the second micro switch 331 is thusly switched to the closed position, an output signal, which indicates that the trip operation of the circuit breaker has been performed, is output via the output terminal 331*a* of the second micro switch 331.

The corresponding output signal is transferred to the OCR 200 so as to be used for displaying that the trip operation of the circuit breaker has been performed, to be stored in a memory as state information, and/or to be transmitted as state information to the monitoring console located at the remote area.

Hereinafter, an operation of the trip mechanism module of the apparatus of the modular trip mechanism and auxiliary mechanism for the circuit breaker in the assembled state, with reference to FIGS. 3 to 6.

A trip operation in response to reception of a trip control signal from the OCR 200 will now be described.

When the OCR 200 detects a fault current, such as an overcurrent or short-circuit current, when such fault current is generated on an electrical power circuit connected with the circuit breaker 1000, the OCR 200 generates a trip control signal.

When the trip control signal is transferred from the OCR 200 to the coil of the electromagnetic trip device 321 via the connector 319 and the lead wire 318, the latch 325 is rotated in response to the movable core 322 being moved forward, and accordingly the trip bar 313*a* is released from the latch 325. Simultaneously, the tensioned spring 313*c* is contracted to pull the trip bar 313*a*. The trip bar 313*a* is thusly moved to the trigger position.

As the trip bar 313*a* is moved to the trigger position, the switching mechanism 100 (see FIG. 1) is triggered to perform a trip operation, accordingly, the movable contact arms for a plurality of electric poles are separated from the corresponding stationary contact arms, thereby completing an automatic circuit breaking (trip) operation.

Hereinafter, description will be given of a trip operation in response to reception of a remote trip control signal from a remote area or an under voltage trip control signal from the OCR 200.

When a remote trip control signal sent from a monitoring console installed at a remote area or an under voltage trip control signal sent from the OCR 200, which has detected a generation of an under voltage on the circuit, is received by the printed circuit board 311*a* of the UVT device or shunt trip mechanism 311 via the connector 317 and the lead wire 316, the corresponding remote trip control signal or the under voltage trip control signal makes the coil of the sub trip mechanism 311*b* shown in FIG. 6 be magnetized and accordingly the magnetic force of the permanent magnet to be offset.

Hence, the output pin 311*b*1 is moved forward by the spring (not shown) so as to press the interlock lever 312*a* to be moved forward. As the interlock lever 312*a* is moved forward, the latch 325 is pressed by the latch pressing portion 312*c*.

The latch 325 is then rotated and releases the trip bar 313*a*. The released trip bar 313*a* is moved to the trigger position by an elastic force applied as the spring 313*c* of FIG. 5 pulls the trip bar 313*a* with being contracted.

As the trip bar 313*a* is moved to the trigger position, the switching mechanism 100 (see FIG. 1) is triggered to perform a trip operation, accordingly, the movable contact arms for the plurality of electric poles are separated from the corresponding stationary contact arms, thereby completing an automatic circuit breaking (trip) operation.

As aforementioned, in an apparatus of modular trip mechanism and auxiliary mechanism for a circuit breaker according to the present disclosure, the auxiliary mechanism and the trip mechanism are modularized, respectively, so that an auxiliary switch, an alarm switch and related components included in the auxiliary mechanism may be configured into one module and also the trip mechanism for triggering the circuit breaker (especially, a switching mechanism of the circuit breaker) to a trip position may be configured into another module. This may result in reduction of the entire size of the circuit breaker and remarkable improvement of assembly and test productivities of the circuit breaker.

The apparatus of the modular trip mechanism and auxiliary mechanism for the circuit breaker according to the present disclosure may further include a supporting base for containing the auxiliary mechanism module and the trip mechanism module in one side and another side thereof, respectively, which allows the auxiliary mechanism module, the trip mechanism module and the supporting base to be configured as one assembly. This may result in minimization of a volume occupied by them in the circuit breaker and improvement of assembly productivity.

The apparatus of the modular trip mechanism and auxiliary mechanism for the circuit breaker according to the present disclosure may include a first shaft contact lever mechanism and a second lever for operating a first micro switch corresponding to the auxiliary switch and a second micro switch corresponding to the alarm switch, respectively. The first shaft contact lever mechanism and the second lever may be artificially driven so as to obtain an effect of simply testing whether or not each micro switch is normally operating prior to being assembled, and other effects of reducing a testing time and improving operation reliability of the completely assembled circuit breaker.

The apparatus of the modular trip mechanism and auxiliary mechanism for the circuit breaker according to the present disclosure may further include return springs contacting the second lever to return the first contact lever device and the second lever to their original positions. Accordingly, when a pressing force applied by a switching shaft is disappeared during a normal operation after assembling the first and second contact lever devices to the circuit breaker or when an external force is disappeared after performing a test operation by applying an artificial pressing force prior to assembling the first shaft contact lever mechanism and the second lever to the circuit breaker, the first shaft contact lever mechanism and the second lever may be automatically moved back to their original positions. Accordingly, a separate manipulation for the return to the original positions may not be required, resulting in providing convenience and fast speed in view of the test operation and convenience in view of operating the circuit breaker.

In the apparatus of the modular trip mechanism and auxiliary mechanism for the circuit breaker according to the present disclosure, the trip mechanism module may include a sub trip mechanism configured by an UVT device or shunt trip device and having a protrusible output pin, and a interlock lever having a power receiving portion installed at one side to face the output pin so as to be contactable with the protruded output pin, and linearly moved in response to being pressed by the output pin to allow for triggering the trip mechanism module. This may allow the sub trip mechanism to be interlocking with the trip mechanism, and also the sub trip mechanism and the trip mechanism to be configured by one trip mechanism module. This may result in obtaining an effect of allowing an under voltage trip operation or remote control trip operation as well as a basic trip operation to be performed by the one trip mechanism module, and other effects of reducing the entire size of the circuit breaker and improving efficiency of component assembling or testing by modularizing corresponding functionalities.

The apparatus of the modular trip mechanism and auxiliary mechanism for the circuit breaker according to the present disclosure may further include lead wires for receiving a test signal for allowing an operation test. Accordingly, an electrical signal, for example, a voltage signal may be applied to the corresponding lead wire so as to test a normal or abnormal operation prior to assembling the corresponding module to the circuit breaker. Therefore, defective components may be chosen out in advance, which may result in ensuring operation reliability of the circuit breaker and improving assembly and test productivity.

The apparatus of the modular trip mechanism and auxiliary mechanism for the circuit breaker according to the present disclosure may further include connectors having a structure with a plurality of pins and holes connected to the lead wires to receive the test signals. Accordingly, the lead wires for applying the test signals may be connected to the connectors via the pins and holes so as to perform testing with respect to the apparatus of the simply modularized trip mechanism and auxiliary mechanism.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. For a circuit breaker having a switching shaft for simultaneously opening or closing three pole electrical power circuits and an overcurrent relay as a controller, an apparatus of modular trip mechanism and auxiliary mechanism for the circuit breaker, the apparatus comprising:

an auxiliary mechanism module including a first micro switch to output an electrical signal indicating an ON or OFF position of the circuit breaker, a first shaft contact lever mechanism rotatable to operate the first micro switch by contacting the switching shaft or receiving an artificial pressing force for testing a normal or abnormal operation, a second micro switch to output an electrical signal indicating whether or not a trip operation of the circuit breaker has been performed, and a second lever rotatable to operate the second micro switch by contacting the switching shaft or receiving an artificial pressing force for testing a normal or abnormal operation; and a trip mechanism module including an electromagnetic trip device having a trip bar as an output unit so as to operate the trip bar to trigger the circuit breaker to a trip position in response to a trip control signal from the overcurrent relay or a test trip control signal from a test signal generating source, wherein the trip mechanism module further includes:

a sub trip mechanism that outputs a mechanical trip signal by protruding an output pin, the sub trip mechanism including an under voltage trip device for outputting the mechanical trip signal when a voltage of a control power source or a voltage of an electrical power circuit is lowered below a predetermined reference voltage or a shunt trip device for outputting the mechanical trip signal when receiving a remote control signal; and an interlock lever having a power receiving portion installed at one side thereof to face the output pin so as to be contactable with the protruded output pin, the interlock lever being linearly moved in response to being pressed by the output pin to trigger the trip mechanism module.

2. The apparatus of claim 1, further comprising:

a supporting base configured by a member having a shape of a container with an open upper surface, the supporting base that contains the auxiliary mechanism module and the trip mechanism module in one side and another side thereof.

3. The apparatus of claim 2, wherein the supporting base comprises a plurality of partitions to define areas for containing and supporting components without great shaking, the components configuring the auxiliary mechanism module and the trip mechanism module, respectively.

4. The apparatus of claim 1, wherein the first shaft contact lever mechanism comprises:

a first lever to receive a contact and pushing force from the switching shaft or an artificial contact pressing force for testing, the first lever rotatable with receiving a lever rotation shaft;

a rolling plate connected to the first lever and rolled in response to rotation of the first lever;

a rolling shaft to rollably support the rolling plate; and a first switch driving protrusion that protrudes upwardly from one side of the rolling plate to operate the first micro switch, and wherein the second lever comprises:

a central shaft receiving portion to receive the lever rotation shaft therein;

a first extending portion inclinedly extending upwardly from the central shaft receiving portion to receive a contact and pushing force from the switching shaft or an artificial pressing force for testing; and a second extending portion extending from the central shaft receiving portion in an opposite direction to the first extending portion to operate the second micro switch.

5. The apparatus of claim 4, further comprising:

return springs contactable with the first lever and the second lever to return the first and second levers to original positions thereof when the force pushing the first lever and the second lever is disappeared.

6. The apparatus of claim 1, wherein the trip mechanism module further includes lead wires to receive a test signal for allowing an operation test.

7. The apparatus of claim 6, wherein the trip mechanism module further includes a connector having a plurality of pins or pin holes connected to the lead wires to receive the test signal.

* * * * *